US006325150B1

(12) United States Patent
Rayssiguier

(10) Patent No.: US 6,325,150 B1
(45) Date of Patent: Dec. 4, 2001

(54) SLIDING SLEEVE WITH SLEEVE PROTECTION

(75) Inventor: Christophe Rayssiguier, Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/517,982

(22) Filed: Mar. 3, 2000

(30) Foreign Application Priority Data

Mar. 5, 1999 (FR) ..... 9902775

(51) Int. Cl.[7] ..... E21B 21/10
(52) U.S. Cl. ..... 166/334.4; 251/344
(58) Field of Search ..... 166/334.1, 334.4, 166/373; 251/343, 344, 214

(56) References Cited

U.S. PATENT DOCUMENTS 3,845,815 * 11/1974 Garwood ..... 166/154
4,602,684 7/1986 VanWormer .
5,479,989 * 1/1996 Shy et al. ..... 166/332.4
5,518,072 5/1996 McTernaghan .

FOREIGN PATENT DOCUMENTS 2315082 1/1998 (GB) .

* cited by examiner

*Primary Examiner*—William Neuder
(74) *Attorney, Agent, or Firm*—Jeffrey E. Griffin; Jaime A. Castano

(57) ABSTRACT

A flow rate control device (18) placed at the bottom of an oil well in production comprises holes (24) formed in the production tubing (16), a closure sleeve (26) suitable for sliding over the holes (24) for controlling the flow rate, and a protective sleeve (34). The protective sleeve (34) is urged by a return spring (36) into a position in which it covers a sealing gasket (32). During closure of the device (18), the two sleeves come into edge-to-edge abutment and the closure sleeve (26) pushes the protective sleeve (34) back against the return spring (36). The sealing gasket (32) is never in direct contact with the fluid in the well. Preferably, the closure sleeve (26) is mounted on the outside of the production tubing (16).

19 Claims, 2 Drawing Sheets

SLIDING SLEEVE WITH SLEEVE PROTECTION

TECHNICAL FIELD

The present invention relates to a device designed to control the downhole flow rate of a petroleum fluid via production tubing.

Such a device may, in particular, be used in an oil well in production to optimize the production of the well over time. It is particularly applicable to the case when the petroleum fluid penetrates into a vertical, horizontal, or deviated well at at least two locations.

STATE OF THE ART

Valves of the on-off type are usually used down oil wells before they are brought on stream. Such valves are installed on the production tubing, where, either initially or at the end of the life of the well (when too much water is produced), they can close off the passage between the inside of the tubing and the annular space that surrounds it. Such a valve usually comprises a slidably-mounted sleeve placed inside the production tubing, and holes formed in the tubing at the level of the sleeve.

When the valve is to be driven in the opening direction or in the closing direction, a suitable tool suspended from a cable or from a tube is lowered inside the production tubing.

More recently, proposals have been made to place adjustable flow rate valves down certain wells in production, in particular in order to optimize production when the petroleum fluid flows into the well at at least two spaced-apart locations.

Documents GB-A-2 314 866 and WO-A-97/37102 relate to such variable flow rate valves.

The variable flow rate valves used for this purpose are derived directly from on-off type valves (internal slidably-mounted sleeve and production tubing provided with holes). They differ from on-off type valves essentially by the fact that they incorporate actuators placed outside the production tubing and remotely controlled from the surface.

Variable flow rate valves play an essential part in optimized well management in oil wells of recent design. It is thus important for them to offer good reliability so that they can operate without maintenance for several years. Any maintenance on such valves is costly (removal and re-insertion of the production tubing), and it results being interrupted, which goes against the object that they are supposed to achieve (optimized well profitability).

One of the essential problems lies in the need to provide dynamic sealing gaskets on the production tubing, on either side of the holes formed therein, so that the valve is properly closed when the closure sleeve occupies the corresponding position.

Such dynamic sealing gaskets are inevitably made of a relatively soft material such as an elastomer. They are thus very fragile. In particular, they are very sensitive to wear, to abrasion, and to fatigue, and they are very poor at withstanding the flow of the petroleum fluid.

Proposals are often made also to form holes in the sleeve. The valve is then fully open when the holes in the sleeve and the holes in the production tubing are in register. The valve is closed when uninterrupted portions of the closure sleeve are in register with the holes in the production tubing.

In the most common case, in which the closure sleeve is suitable for sliding axially relative to the production tubing, that solution leads to causing the holes in the sleeve to go past one of the gaskets when the valve goes from its closed state to its open state, and vice versa. The sealing gasket in question is thus subjected to successive compression and decompression states and might be nipped and cut by the sharp edges of the holes. That accelerates fatigue in the gasket and causes it to wear prematurely.

In addition, the petroleum fluid contains a certain number of impurities such as mud and sand that lodge in the holes in the closure sleeve when the valve is open. The impurities then come into contact with the gasket in question when the sleeve slides subsequently. The gasket is thus subjected to abrasion which accelerates wear on it.

Another problem appears when the valve is opened after being closed for a certain amount of time. There is then a pressure difference which is sometimes large between the dynamic pressure inside the production tubing and the higher static pressure outside the tubing in the underground reservoir being tapped. On valve opening, the pressure equalization that tends to occur between the outside and the inside of the production tubing immediately imparts a high flow rate to the petroleum fluid. The high-rate flow sweeps the surface of the sealing gasket which is then always situated facing the holes formed in the closure sleeve. If no particular precaution is taken, the gasket is then torn away or else it wears very rapidly.

In an attempt to remedy that drawback, it is common to limit the rate of the flow reaching the sealing gasket in question by interposing rings (generally made of metal or of polytetrafluoroethylene) between the gasket and the holes provided in the production tubing. However, such rings are not very effective, and they do not prevent the gasket from suffering accelerated damage as a result of the valve being opened.

Another problem caused by the use of a closure sleeve that is provided with holes is constituted by the edges of the holes wearing rapidly under the effect of the flow of the petroleum fluid. One known remedy to that problem consists in beveling the edges of the holes in the sleeve in the fluid flow direction. However, that also has a detrimental effect on the gaskets which tend to be cut by the beveled edges of the holes in the closure sleeve when said edges arrive at the gaskets.

SUMMARY OF THE INVENTION

According to the invention, there is provided a flow rate control device for controlling the flow rate through production tubing placed in an oil well, the device comprising at least one hole formed in the production tubing, a closure sleeve suitable for sliding over said hole, and sealing means mounted on the tubing on either side of said hole so as to co-operate in fluid-tight manner with the closure sleeve, said device further comprising a protective sleeve mounted in alignment with the closure sleeve, and return means for bringing the protective sleeve automatically into a covering position in which it covers first ones of the sealing means when they are not covered by the closure sleeve.

By means of this configuration, the first sealing means are always covered either by the closure sleeve, when the device is in the closed state, or by the protective sleeve, when the device is open, or else by both sleeves in end-to-end abutment, when the device is almost closed. The sealing means are thus never directly subjected to the flow of the petroleum fluid. Any abrasion wear on the sealing means is thus limited. In addition, the sealing means are permanently compressed so that any fatigue wear is prevented.

In a preferred embodiment of the invention, the return means comprise resilient means interposed between the production tubing and the protective sleeve.

When in the covering position, the protective sleeve is in abutment against an abutment surface associated with the production tubing.

Advantageously, the closure sleeve is suitable for moving between a closure position in which it covers the sealing means and a controlled opening position in which a front edge of the closure sleeve co-operates with said hole to form a through hole of variable section.

In which case, the protective sleeve preferably occupies the covering position so long as the closure sleeve occupies the controlled opening position, the front edge of the closure sleeve being suitable for engaging a rear edge of the protective sleeve while the closure sleeve is moving towards its closure position. The first sealing means are thus always covered fully by at least one of the sleeves, namely the closure sleeve or the protective sleeve.

In this configuration, the front edge of the closure sleeve is advantageously formed on a separate annular portion made of a material having high resistance to erosion wear, such as a ceramic. This characteristic makes it possible to improve the life-span of the closure sleeve significantly.

In comparable manner, in order to reduce the wear on the holes formed in the production tubing, a separate ring made of a material having high resistance to wear may be associated with the production tubing and interposed between said tubing and the closure sleeve at the same level as the hole. The separate ring is then provided with another hole that faces said hole and that is smaller in section.

The closure sleeve is advantageously mounted on the outside of the production tubing.

The resilient means then advantageously comprise a compression spring mounted on the outside of the production tubing between the protective sleeve and a shoulder formed on said tubing.

In which case, a cover is placed around the compression spring in order to prevent it from being in direct contact with the fluid from the well. This cover thus protects the spring while the device is being installed in the well. The protective sleeve, the compression spring, and the cover form an assembly suitable for being mounted as a single unit on the production tubing.

BRIEF DESCRIPTION OF THE DRAWINGS

A preferred embodiment of the invention is described below by way of non-limiting example and with reference to the accompanying drawings, in which.

DETAILED DESCRIPTION OF A PREFERRED EMBODIMENT OF THE INVENTION

Figure 1:
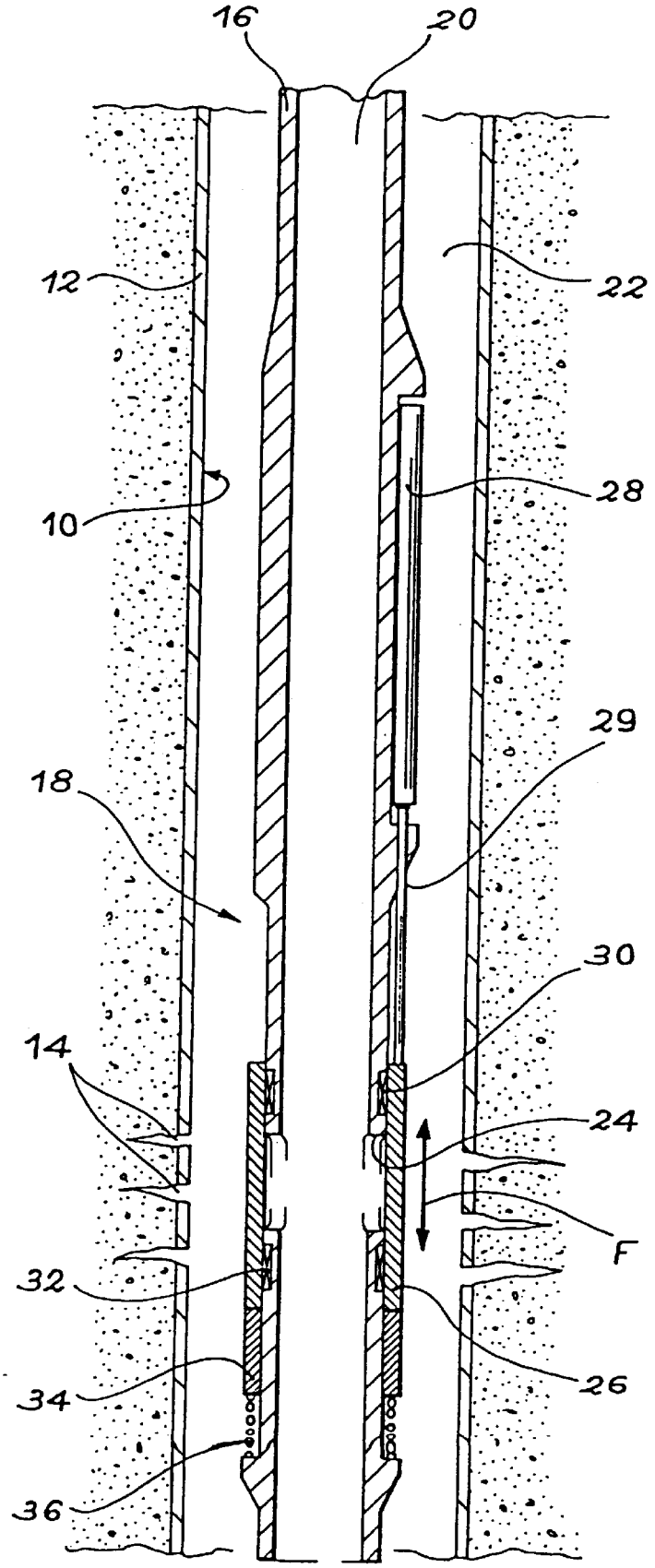
FIG. 1 is a diagrammatic section view of a flow rate control device of the invention, as installed in the bottom of an oil well.

In FIG. 1, reference 10 designates an oil well in production, only a bottom region of which is shown. It should be noted that said bottom region may extend vertically, as shown, or horizontally, or on a slope, without going beyond the ambit of the invention. When the flow rate control device is placed in a horizontal or deviated region of a well, the expressions such as "downwards" and "upwards" used in the following description then mean respectively "away from the surface" and "towards the surface".

The walls of the oil well 10 are reinforced with casing 12. In the region of the well shown in FIG. 1, the casing 12 is perforated at 14 so as to cause the well to communicate with a natural deposit of petroleum fluid (not shown).

To enable the petroleum fluid to be conveyed to the surface, production tubing 16 is received coaxially in the well 10 over its entire depth. The production tubing 16 is made up of a plurality of tubing segments interconnected end-to-end. One of the segments, shown in FIG. 1, forms the body of the flow rate control device 18 of the invention. To simplify the description, the expression "production tubing" is used below to cover both the entire string of tubing, and also the specific segment of tubing.

Internally, the production tubing 16 defines a channel 20 via which the petroleum fluid rises towards the surface. The annular space 22 defined between the production tubing 16 and the casing 12 of the well 10 is closed, on either side of the flow rate control device 18 by annular sealing systems (not shown). Therefore, the petroleum fluid coming from the natural deposit (not shown) and admitted into the well via the perforations 14 can rise to the surface via the central channel 20 only by flowing through the flow rate control device 18.

Essentially, the flow rate control device 18 comprises at least one hole 24 formed in the production tubing 16, a closure sleeve 26, and drive means 28.

In practice, the flow rate control device 18 comprises a plurality of holes 24 distributed uniformly over the entire circumference of the production tubing 16. For example, each of the holes 24 has a shape that is elongate in the axial direction of the tubing. The holes 24 may however be of any number or of any shape without going beyond the ambit of the invention.

The closure sleeve 26 is mounted on the production tubing in a manner such that it can move parallel to the axis of the production tubing. More precisely, the closure sleeve 26 is suitable for moving between a "bottom" or "front" position shown in FIGS. 1 and 3, corresponding to the flow rate control device 18 being closed, and a "top" or "rear" position (FIG. 2), corresponding to the device 18 being fully open. Between these two extreme positions, the closure sleeve 26 may be moved continuously so as to vary the through section of the flow rate control device 18 and, as a result, so as to vary the flow rate of the petroleum fluid flowing through the device.

In the preferred embodiment of the invention shown in the figures, the closure sleeve 26 is mounted on the outside of the production tubing 16. However, the flow rate control device 18 of the invention is not limited to this mounting configuration, and it also covers configurations in which the closure sleeve 26 is placed inside the production tubing.

The drive means 28 comprise an actuator mounted outside the production tubing 16. The actuator, which is, for example, of the electromechanical type or of the hydraulic type, is suitable for moving the closure sleeve 26 continuously and in controlled manner parallel to the axis of the production tubing 16 as represented diagrammatically by arrow F in FIG. 1.

As mentioned above, installing the closure sleeve 26 outside the production tubing 16 makes it possible to simplify the device and to facilitate assembly thereof. The actuator can thus act on the closure sleeve without it being necessary for it to pass through the production tubing. In addition, the various parts can be assembled together by being fitted together axially, with the closure sleeve 26 being formed in one piece, and the corresponding segment of production tubing 16 being in one piece as well.

The drive means 28 act on the closure sleeve 26 via a link part 29 which may be of any shape without going beyond the ambit of the invention.

Figure 3:
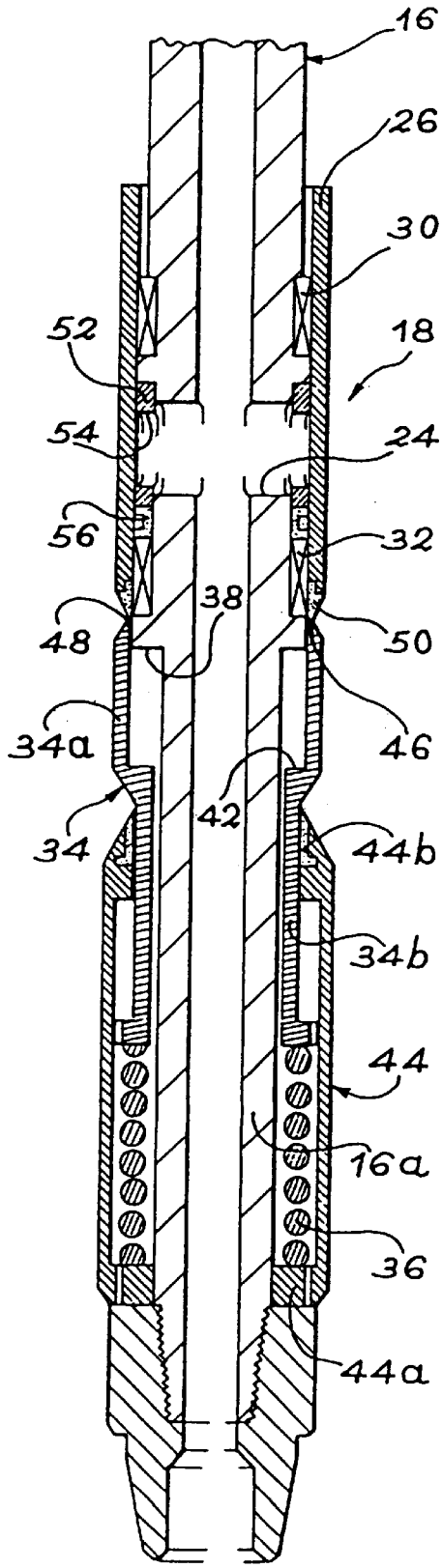
FIG. 3 is a view comparable to FIG. 2, showing the device in its closed position.

Sealing means are provided on the production tubing 16 on either side of the holes 24 so as to co-operate in fluid-tight manner with the closure sleeve 26 when said sleeve is in its closed state, as shown in FIGS. 1 and 3. More precisely, sealing means 30 are mounted on the tubing 16 above the holes 24, and sealing means 32 are mounted on the tubing 16 below the holes 24.

In the embodiment shown, in which the closure sleeve 26 is placed outside the production tubing 16, the sealing means 30 and 32 are placed in annular grooves formed in the outside surface of the tubing 16 so as to co-operate in fluid-tight manner with the cylindrical inside surface of the closure sleeve 26.

The sealing means 30 and 32 are usually constituted by dynamic sealing gaskets that are annular in shape and that are made of a flexible material such as an elastomer.

In addition, below the closure sleeve 26 and in alignment therewith, the flow rate control device 18 includes a protective sleeve 34. Essentially, the function of the protective sleeve 34 is to provide continuity in covering the sealing means 32 when the closure sleeve 26 moves upwards, i.e. when the drive means 28 are actuated in the opening direction of the flow rate control device 18.

Finally, the flow rate control device 18 also includes return means 36 designed and organized in a manner such as to bring the protective sleeve 34 automatically into a position in which it covers the sealing means 32 when said sealing means do not co-operate with the closure sleeve 26.

The bottom portion of the flow rate control device 18 is described in more detail below with reference to FIGS. 2 and 3.

In its portion situated below the sealing means 32, the production tubing 16 has a portion 16*a* of relatively small diameter, defined at the top by a first shoulder 38 and at the bottom by a second shoulder 40. As shown in FIGS. 2 and 3, the second shoulder 40 may in particular be implemented in the form of the top face of another segment of the production tubing 16 or by some other separate part screwed to the bottom end of the portion 16*a* of relatively small diameter.

The protective sleeve 34 includes a top portion 24*a* of relatively large diameter, and a bottom portion 34*b* of relatively small diameter. The top portion 34*a* is organized to slide snugly on that portion of the production tubing 16 which carries the sealing means 32, while the bottom portion 34*b* is received with clearance around the portion 16*a* of relatively small diameter of the tubing 16. The top portion 34*a* and the bottom portion 34*b* of the protective sleeve 34 are separated from each other internally by a shoulder 42 suitable for coming into abutment against the first shoulder 38 which thus forms an abutment surface on the production tubing 16.

Figure 2:
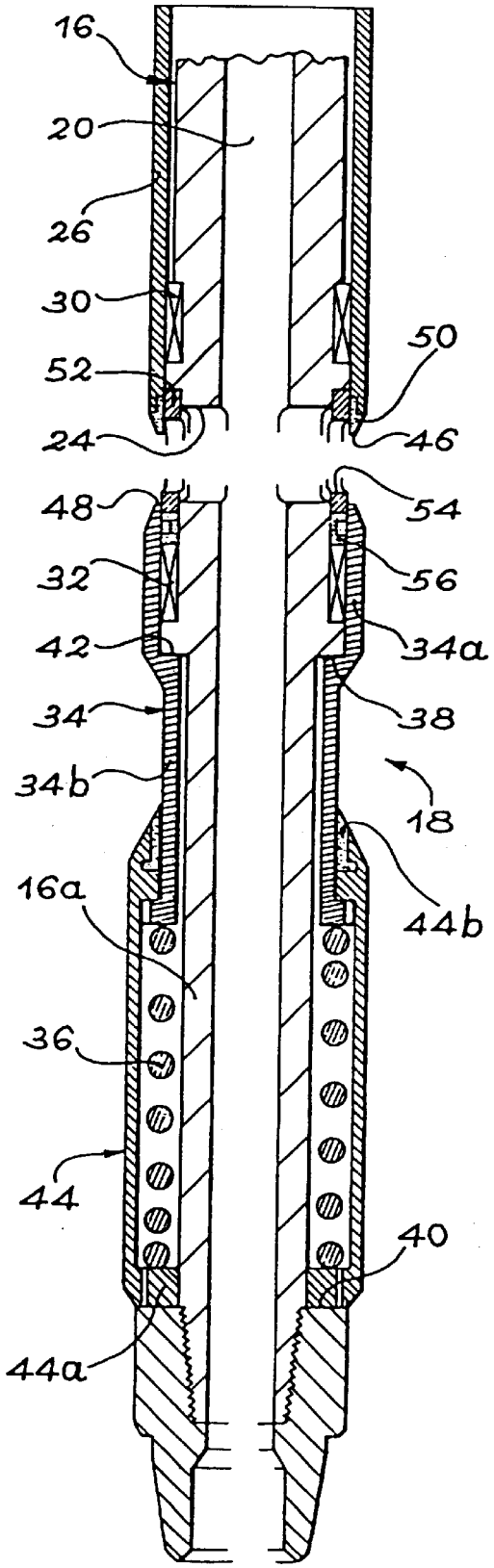
FIG. 2 is a section view on a larger scale showing the bottom portion of the device shown in FIG. 1, in its fully-open position.

In the preferred embodiment of the invention shown in FIGS. 2 and 3, the return means 36 comprise resilient means constituted by a compression spring. This compression spring is disposed around the portion 16*a* of relatively small diameter of the production tubing 16. Its top end is in abutment against the bottom face of the protective sleeve 34, and its bottom end is in abutment against the second shoulder 40 formed on the tubing 16.

By means of this configuration, when the closure sleeve 26 takes up a fully open or partially open position, as shown in FIG. 2, the return means 36 hold the protective sleeve 34 in abutment against the abutment surface formed by the first shoulder 38. Under these conditions, the top portion 34*a* of relatively large diameter of the protective sleeve 34 covers the sealing means 32 snugly over their entire height. More precisely, the top end of the protective sleeve 34 is then flush with the bottoms of the holes 24 provided in the production tubing 16. Thus, the sealing means 32 are substantially not in contact with the fluid in the well, and they are maintained in a compressed state.

As also shown in FIGS. 2 and 3, the compression spring constituting the return means 36 is advantageously protected from the fluid in the well by a cover 44. This cover 44 is tubular in overall shape, and it is provided with a bottom flange 44*a* interposed between the second shoulder 40 and the bottom end of the compression spring. The cover 44 is thus prevented from moving relative to the production tubing 16.

The cover 44 is mounted on the bottom portion 34*b* of the protective sleeve 34 in a manner such that it co-operates therewith and with the compression spring 36 to form an assembly suitable for being mounted as a single unit on the production tubing 16.

As shown in FIGS. 2 and 3, the top portion 44*b* of the protective cover 44 is beveled and reinforced so as to form a scraper flush with the outside surface of the bottom portion 34*b* of the protective sleeve 34. The scraper formed in this way makes it possible to clean the surface when the protective sleeve 34 moves downwards against the return means 36.

In the flow rate control device 18 formed in this way, the closure sleeve 26 has no holes. The through section of the device, which section enables the flow rate to be controlled, is defined between the bottom or front edge 46 of the closure sleeve 26 and the holes 24 provided in the production tubing 16. More precisely, the further the front edge 46 moves upwards, the greater the through section of the device, and vice versa.

So long as the front edge 46 of the closure sleeve 26 remains in a partially open or fully open position as shown in FIG. 2, the protective sleeve 34 remains in abutment against the abutment surface formed by the shoulder 38.

When the closure sleeve 26 moves downwards to close the flow rate control device 18, the front edge 46 of the sleeve comes into abutment against the top or rear edge 48 of the protective sleeve 34, so as to push said protective sleeve progressively downwards against the return means 36 (FIG. 3). During this movement, the plane edges 46 and 48 are in abutment against each other over their entire circumference so that the sealing means 32 are constantly covered either by the protective sleeve 34, or in part by the protective sleeve 34 and in part by the closure sleeve 26 while said closure sleeve is descending, or else entirely by the closure sleeve 26 when the device is in the closed position, as shown in FIG. 3.

Therefore, regardless of the state in which the flow rate control device 18 is situated, the sealing means 32 are never exposed directly to the fluid in the well. In addition, they remain compressed continuously. The various causes of wear (abrasion, fatigue, etc.) to which the sealing means are subjected in prior art flow rate control devices are thus minimized.

In addition, because the flow rate is entirely controlled by the position of the front edge 46 of the closure sleeve 26, i.e. by a surface having a simple circular shape, it is possible to form this edge on a separate annular portion 50 made of a material having high resistance to erosion wear, such as a ceramic. This configuration, as shown in FIGS. 2 and 3, makes it possible to reduce wear on the edge 46 of the closure sleeve very significantly. This contributes to increasing the life span of the device.

Advantageously, and as also shown in FIGS. 2 and 3, that portion of the production tubing 16 in which the holes 24 are formed is surrounded, between the sealing means 30 and 32, by a separate ring 52 made of a material having high resistance to erosion wear, such as a ceramic. More precisely, the separate ring 52 is interposed between the tubing 16 and the closure sleeve 26, at the same level as the holes 24. In register with each of the holes 24, it is provided with another hole 54 that is slightly smaller in section. When the flow rate control device is open, this configuration makes it possible to reduce significantly the wear on the edges of the holes 24 provided in the production tubing 16.

By way of precaution, and as shown in FIGS. 2 and 3, one or more rings 56 may be placed on the production tubing 16 between the holes 24 and the sealing means 32. These rings 56 are made of metal or of polytetrafluoroethylene, and they provide additional protection for the sealing means 32 by forming a filter which holds back impurities such as mud and sand.

These various complementary configurations may be advantageously combined with the protective sleeve 34 to increase very significantly the life-span of the flow rate control device as a whole. However, none of them is essential to the invention.

Naturally, the invention is not limited to the embodiment described above by way of example. Thus, instead of sliding parallel to the axis of the production tubing, the closure sleeve may move over a different path, such as a helical path. In addition, the device may be opened by the closure sleeve moving downwards. In which case, the protective sleeve is placed above said closure sleeve so as to protect the sealing means situated above the holes, when they are not covered by the closure sleeve.

I claim:

1. A flow control device for controlling the flow rate through tubing placed in an oil well, the tubing including at least one hole therethrough, the device comprising:

a closure sleeve adapted to slide over the tubing hole;

a first seal and a second seal respectively mounted on the tubing on either side of the tubing hole, the first and second seals cooperating in a fluid-tight manner with the closure sleeve;

a protective sleeve mounted in alignment with the closure sleeve and proximate to the first seal; and a return mechanism for automatically returning the protective sleeve to a covering position in which the protective sleeve covers the first seal when the first seal is not covered by the closure sleeve.

2. A device according to claim 1, wherein the return mechanism comprises a spring interposed between the tubing and the protective sleeve.

3. A device according to claim 2, wherein:

the closure sleeve is mounted on the outside of the tubing; and the spring is mounted on the outside of the tubing between the protective sleeve and a shoulder defined on the tubing.

4. A device according to claim 3, wherein a cover is placed around the spring.

5. A device according to claim 4, wherein the protective sleeve, the spring, and the cover form an assembly adapted to be mounted as a single unit on the tubing.

6. A device according to claim 1, wherein the protective sleeve is in abutment against an abutment surface of the tubing when the protective sleeve is in the covering position.

7. A device according to claim 1, wherein the closure sleeve is adapted to move between a closure position, in which the closure sleeve covers the first and second seals, and a controlled opening position, in which a front edge of the closure sleeve cooperates with the tubing hole to form a through hole of variable section.

8. A device according to claim 7, wherein:

the protective sleeve occupies the covering position as long as the closure sleeve occupies the controlled opening position;

the front edge of the closure sleeve is adapted to engage a rear edge of the protective sleeve while the closure sleeve is moving towards its closure position;

so that the first seal is always covered fully by at least one of the closure sleeve and the protective sleeve.

9. A device according to claim 1, wherein the closure sleeve is mounted on an outer surface of the tubing.

10. A flow control device for controlling the flow rate through tubing placed in an oil well, the tubing including at least one hole therethrough, the device comprising:

a closure sleeve adapted to slide over the tubing hole;

a first seal on one side of the tubing hole and a second seal mounted on the tubing on the other side of the tubing hole, the first and second seals cooperating in a fluid-tight manner with the closure sleeve;

a protective sleeve mounted in alignment with the closure sleeve and proximate to the first seal; and a return mechanism for automatically returning the protective sleeve to a covering position in which the protective sleeve covers the first seal when the first seal is not covered by the closure sleeve;

wherein the closure sleeve is adapted to move between a closure position, in which the closure sleeve covers the first and second seals, and a controlled opening position, in which a front edge of the closure sleeve cooperates with the tubing hole to form a through hole of variable section; and wherein the front edge of the closure sleeve is formed on a separate annular portion made of material having high resistance to wear.

11. A flow control device for controlling the flow rate through tubing placed in an oil well, the tubing including at least one hole therethrough, the device comprising:

a closure sleeve adapted to slide over the tubing hole;

a first seal on one side of the tubing hole and a second seal mounted on the tubing on the other side of the tubing hole, the first and second seals cooperating in a fluid-tight manner with the closure sleeve;

a protective sleeve mounted in alignment with the closure sleeve and proximate to the first seal;

a return mechanism for automatically returning the protective sleeve to a covering position in which the protective sleeve covers the first seal when the first seal is not covered by the closure sleeve;

a separate ring interposed between the tubing and the closure sleeve at the same level as the hole;

the separate ring made from a material having a high resistance to wear; and the separate ring providing another hole that faces the tubing hole and that is smaller in section in relation thereto.

12. A well completion, comprising:

a tubing including at least one hole therethrough;

a closure sleeve adapted to slide over the tubing hole;

a first seal and a second seal respectively mounted on the tubing on either side of the tubing hole, the first and second seals cooperating in a fluid-tight manner with the closure sleeve;

a protective sleeve mounted in alignment with the closure sleeve and proximate to the first seal; and a return mechanism for automatically returning the protective sleeve to a covering position in which the protective sleeve covers the first seal when the first seal is not covered by the closure sleeve.

13. A flow control device for controlling the flow rate through tubing placed in an oil well, the tubing including at least one hole therethrough, the device comprising:

a closure sleeve adapted to slide over the tubing hole;

a first seal and a second seal respectively mounted on the tubing on either side of the tubing hole so as to cooperate in a fluid-tight manner with the closure sleeve;

a protective sleeve adapted to slide on the tubing and mounted proximate the first seal; and the closure sleeve and the protective sleeve sliding in relation to the first seal so that the first seal is always covered fully by at least one of the closure sleeve and the protective sleeve.

14. A flow control device as claimed in claim 13, wherein the closure sleeve and the protective sleeve are adapted to slide between a position in which the closure sleeve covers the first seal, and a position in which the protective sleeve covers the first seal.

15. A flow control device for controlling the flow rate through tubing placed in an oil well, the tubing including at least one hole therethrough, the device comprising:

a closure sleeve adapted to slide over the tubing hole;

a first seal mounted on the tubing on one side of the tubing hole and a second seal mounted on the tubing on the other side of the tubing hole, the first and second seals cooperating in a fluid-tight manner with the closure sleeve;

a protective sleeve mounted in alignment with the closure sleeve and proximate to the first seal; and the closure sleeve and the protective sleeve are adapted to slide between a position in which the closure sleeve covers the first and second seals, and a position in which the closure sleeve covers the second seal and the protective sleeve covers the first seal.

16. A flow control device as claimed in claim 15, further comprising:

a return means for automatically returning the protective sleeve to a covering position in which the protective sleeve covers the first sealing means when the first sealing means are not covered by the closure sleeve.

17. A flow control device for controlling the flow rate through tubing placed in an oil well, the tubing including at least one hole therethrough, the device comprising:

a closure sleeve adapted to slide over the tubing hole;

a first seal area mounted on the tubing on one side of the tubing hole and a second seal area mounted on the tubing on the other side of the tubing hole, the first and second seal areas cooperating in a fluid-tight manner with the closure sleeve;

a protective sleeve mounted in alignment with the closure sleeve and proximate to the first seal area; and a return mechanism for automatically returning the protective sleeve to a covering position in which the protective sleeve covers the first seal area when the first seal area is not covered by the closure sleeve.

18. A well completion, comprising:

a tubing including at least one hole therethrough;

a closure sleeve adapted to slide over the tubing hole;

a first sealing means mounted on the tubing on one side of the tubing hole and a second sealing means mounted on the tubing on the other side of the tubing hole, the first and second sealing means cooperating in a fluid-tight manner with the closure sleeve;

a protective sleeve mounted in alignment with the closure sleeve and proximate to the first sealing means; and a return means for automatically returning the protective sleeve to a covering position in which the protective sleeve covers the first sealing means when the first sealing means is not covered by the closure sleeve.

19. A flow control device for controlling the flow rate through tubing placed in an oil well, the tubing including at least one hole therethrough, the device comprising:

a closure sleeve adapted to slide over the tubing hole;

a first sealing means mounted on the tubing on one side of the tubing hole and a second sealing means mounted on the tubing on the other side of the tubing hole, the first and second sealing means cooperating in a fluid-tight manner with the closure sleeve;

a protective sleeve mounted in alignment with the closure sleeve and proximate to the first sealing means; and the closure sleeve and the protective sleeve are adapted to slide between a position in which the closure sleeve covers the first and second sealing means, and a position in which the closure sleeve covers the second sealing means and the protective sleeve covers the first sealing means.

* * * * *